US009745998B2

(12) United States Patent
Uehara et al.

(10) Patent No.: US 9,745,998 B2
(45) Date of Patent: Aug. 29, 2017

(54) CENTRIFUGAL AIR BLOWER

(71) Applicant: Panasonic Intellectual Property Management Co., Ltd., Osaka (JP)

(72) Inventors: Akimasa Uehara, Aichi (JP); Satoshi Ousaka, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 195 days.

(21) Appl. No.: 14/859,206

(22) Filed: Sep. 18, 2015

(65) Prior Publication Data

US 2016/0090993 A1 Mar. 31, 2016

(30) Foreign Application Priority Data

Sep. 26, 2014 (JP) ..... 2014-196567

(51) Int. Cl.
*F04D 29/42* (2006.01)
*F04D 29/44* (2006.01)
*F04D 29/62* (2006.01)

(52) U.S. Cl.
CPC ..... *F04D 29/4226* (2013.01); *F04D 29/441* (2013.01); *F04D 29/626* (2013.01)

(58) Field of Classification Search
CPC .. F04D 29/4226; F04D 29/626; F04D 29/441; F04D 29/422; F04D 29/663; F04D 29/667; F05D 2250/52
See application file for complete search history.

(56) References Cited

U.S. PATENT DOCUMENTS 6,168,378 B1 * 1/2001 Craw ..... F04D 29/441 415/211.2
8,678,759 B2 * 3/2014 Sinzaki ..... F04D 29/422 415/204
2004/0062646 A1 * 4/2004 Nomura ..... F04D 29/441 415/206
2005/0196306 A1 * 9/2005 Del Zanno ..... F04D 25/06 417/423.15
2008/0193284 A1 * 8/2008 Hoeffken ..... B23P 15/00 415/203
2010/0183433 A1 * 7/2010 Sinzaki ..... F04D 29/663 415/204

FOREIGN PATENT DOCUMENTS

JP 5303877 B 10/2013

* cited by examiner

*Primary Examiner* — Gregory Anderson
*Assistant Examiner* — Eldon Brockman
(74) *Attorney, Agent, or Firm* — McDermott Will & Emery LLP

(57) ABSTRACT

A centrifugal air blower includes a casing having a spiral scroll, an impeller contained in the casing, an inlet side panel having an inlet, and a motor-fixing side panel fixing a motor. The centrifugal air blower further includes a first triangle wall and a second triangle wall at a discharge outlet opposite to a tongue. The triangle wall where air velocity inside the casing is slower is shaped with a longer vector component (length B) in the direction from the discharge outlet to the impeller than the other triangle wall. This configuration makes the air velocity near the discharge outlet uniform and suppresses a decrease of static pressure, an increase of power consumption, and turbulent flow noise.

5 Claims, 4 Drawing Sheets

CENTRIFUGAL AIR BLOWER

BACKGROUND OF THE INVENTION

1. Field of the Invention

The present invention relates to a structure of a centrifugal air blower used for a ventilating blower such as a duct fan and for an air conditioner, for example.

2. Background Art

An existing centrifugal air blower is provided with a tapered wall at the part opposite to the tongue near the discharge outlet of the scroll to make the air velocity near the discharge outlet uniform for suppressing pressure loss and noise generated due to airflow turbulence near the discharge outlet of the casing. Such an existing centrifugal air blower is disclosed in Japanese Patent No. 5303877 for example.

Next, a description is made of the existing example referring to FIG. 5.

As shown in FIG. 5, centrifugal air blower 101 is composed of casing 102 and impeller 103 contained in casing 102. Casing 102 is composed of inlet side panel 105 having inlet 104, spiral scroll 106, and motor-fixing side panel 108 fixing motor 107. Casing 102 is spiral so that the flow path cross-sectional area (i.e., the radially cross-sectional area in the area enclosed by the outer circumference of impeller 103, the inside of scroll 106, and the side panels) is gradually larger from tongue 109 toward rotation direction 110 of impeller 103.

Impeller 103 is fixed to motor 107. When motor 107 is driven to rotate impeller 103, inlet airflow 111 flows from inlet 104 into casing 102 through impeller 103. The air that has blown out from impeller 103 is pressure-boosted and converted from dynamic pressure to static pressure in casing 102, and flows out from discharge outlet 112 as discharge airflow 113. Tapered wall 114 is formed at the part of discharge outlet 112 opposite to tongue 109. Owing to tapered wall 114, the cross-sectional area formed by casing 102 cut along a plane vertical to rotation shaft 115 of motor 107 gradually becomes smaller toward the side panels (i.e., inlet side panel 105 and motor-fixing side panel 108).

In typical centrifugal air blower 101, the airflow velocity inside casing 102 is supposedly slower near the side panels (i.e., inlet side panel 105 and motor-fixing side panel 108). The difference in airflow velocity unstabilizes the airflow direction near discharge outlet 112 to generate a turbulent flow. With this structure, the cross-sectional area of casing 102 at the side panels (i.e., inlet side panel 105 and motor-fixing side panel 108), where the airflow velocity is slower, is made smaller by means of tapered wall 114, thereby increasing the volume of air passing through the unit area. That is, the slower velocity of airflow can be increased. In this way, increasing the airflow velocity near the side panels (i.e., inlet side panel 105 and motor-fixing side panel 108) makes the air velocity near discharge outlet 112 uniform to some extent, thereby decreasing airflow turbulence to some degree.

SUMMARY OF THE INVENTION

Such existing centrifugal air blower 101 suppresses a decrease of static pressure, an increase of power consumption, and turbulent flow noise, caused by airflow turbulence near discharge outlet 112. However, the airflow velocity near inlet side panel 105 is different from that near motor-fixing side panel 108, and thus the airflow velocity cannot be increased to an intended level depending on the shape of tapered wall 114, especially at the side panels where the air velocity is slower, which insufficiently makes the airflow velocity near discharge outlet 112 uniform.

An object of the present invention is to provide a centrifugal air blower that further decreases airflow turbulence near the discharge outlet by devising the shape of the tapered wall according to the airflow velocity at the side panels (i.e., the inlet side panel and the motor-fixing side panel).

To attain the above-described object, a centrifugal air blower of the present invention includes a casing and an impeller contained in the casing. The casing includes a discharge outlet, a tongue, a spiral scroll, an inlet side panel having an inlet, and a motor-fixing side panel fixing the motor. The centrifugal air blower further includes a first triangle wall and a second triangle wall. The first surface is enclosed by the scroll, the inlet side panel, and the open face of the discharge outlet, at the part opposite to the tongue near the discharge outlet. The second surface is enclosed by the scroll, the motor-fixing side panel, and the open face of the discharge outlet, at the part opposite to the tongue near the discharge outlet. The first surface is inclined downward to the tongue toward the inlet side panel. The second surface is inclined downward to the tongue toward the motor-fixing side panel. When the air velocity inside the casing when the motor is driven is slower at the inlet side panel than at the motor-fixing side panel, the first triangle wall is shaped with a vector component in the direction from the discharge outlet to the impeller longer than the second triangle wall. When the air velocity inside the casing when the motor is driven is slower at the motor-fixing side panel than at the inlet side panel, the second triangle wall is shaped with a vector component in the direction from the discharge outlet to the impeller longer than the first triangle wall.

Owing to this configuration, the cross-sectional area formed by the casing cut along a plane vertical to the rotation shaft of the motor gradually becomes smaller toward the side panels (i.e., the inlet side panel and the motor-fixing side panel), in the area where the air flows in the casing. In a typical centrifugal air blower, the airflow velocity inside the casing is supposedly slower near the side panels. The cross-sectional area of the casing at the side panels, where the airflow velocity is slower, is made smaller, thereby increasing the volume of air passing through the unit area. That is, the slower velocity of airflow can be increased. This configuration provides a centrifugal air blower that makes the air velocity near the discharge outlet uniform to decrease airflow turbulence.

DETAILED DESCRIPTION OF PREFERRED EMBODIMENTS

Hereinafter, a description is made of some embodiments of the present invention with reference to the related drawings.

First Exemplary Embodiment

Figure 1:
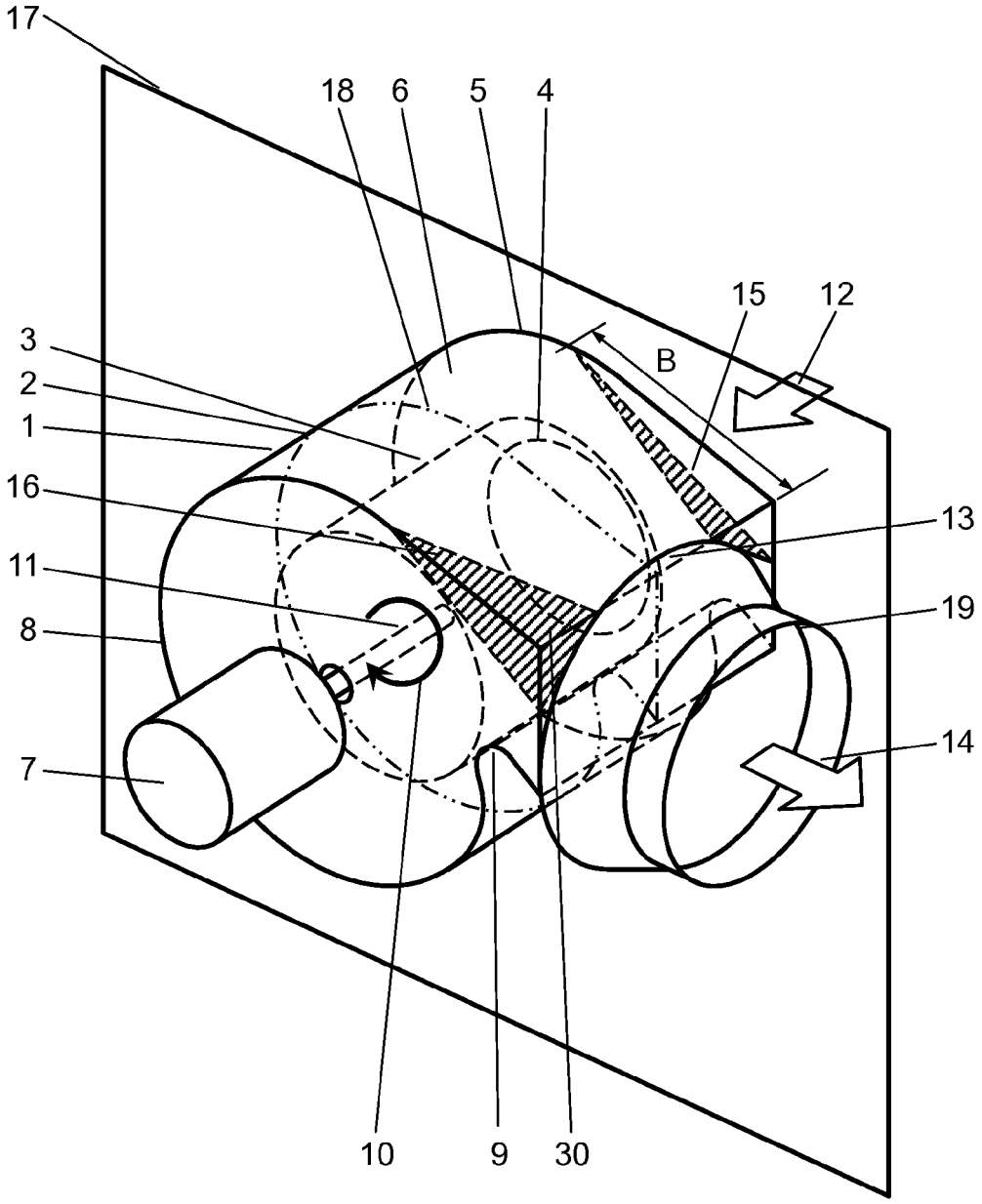
FIG. 1 is a perspective view of a centrifugal air blower according to the first exemplary embodiment of the present invention.

As shown in FIG. 1, centrifugal air blower 1 of this embodiment includes casing 2 and impeller 3 contained in casing 2.

Casing 2 includes inlet side panel 5 having inlet 4, spiral scroll 6, and motor-fixing side panel 8 fixing motor 7. Casing 2 is spiral so that its flow path cross-sectional area is gradually larger from tongue 9 toward rotation direction 10 of impeller 3.

Impeller 3 is fixed to rotation shaft 11 of motor 7. When motor 7 is driven to rotate impeller 3, inlet airflow 12 flows from inlet 4 into casing 2 through impeller 3, is pressure-boosted and converted from dynamic pressure to static pressure in spiral casing 2, and flows out from discharge outlet 13 as discharge airflow 14.

Discharge outlet 13 is provided with round adaptor 19 that continuously connects rectangular discharge outlet 13 with a round duct (unillustrated).

At the part of discharge outlet 13 opposite to tongue 9 (opposite-to-tongue 30), there is first triangle wall 15 enclosed by scroll 6, inlet side panel 5, and the open face of discharge outlet 13, all of which form three sides of the triangle. In this embodiment, one side of first triangle wall 15 is in contact with scroll 6; another, with inlet side panel 5; and the other, with the open face of discharge outlet 13.

At the part of discharge outlet 13 opposite to tongue 9 (opposite-to-tongue 30), there is second triangle wall 15 enclosed by scroll 6, motor-fixing side panel 8, and the open face of discharge outlet 13, all of which form three sides of the triangle. In this embodiment, one side of second triangle wall 16 is in contact with scroll 6; another, with motor-fixing side panel 8; and the other, with the open face of discharge outlet 13.

Note that first triangle wall 15 and second triangle wall 16 are triangle, but may be substantially triangle with round angles.

First triangle wall 15 is inclined downward to tongue 9 toward inlet side panel 5. Second triangle wall 16 is inclined downward to tongue 9 toward motor-fixing side panel 8. In other words, first triangle wall 15 is shaped so that cross-sectional area 18 where the air flows in casing 2 cut along a plane vertical to rotation shaft 11 of motor 7 gradually becomes smaller toward the side panel (inlet side panel 5). Second triangle wall 16 is shaped so that cross-sectional area 18 where the air flows in casing 2 cut along a plane vertical to rotation shaft 11 of motor 7 gradually becomes smaller toward the side panel (motor-fixing side panel 8).

FIG. 1 shows a case where the air velocity inside casing 2 is slower at inlet side panel 5 than at motor-fixing side panel 8 when motor 7 is driven. In this case, first triangle wall 15 is made to be shaped with a longer vector component (length B) in the direction from discharge outlet 13 to impeller 3 than second triangle wall 16. In other words, first triangle wall 15 is made to have an area larger than second triangle wall 16.

Meanwhile, contrarily to FIG. 1, in a case where the air velocity inside casing 2 is slower at motor-fixing side panel 8 than at inlet side panel 5 when the motor is driven, second triangle wall 16 is made to be shaped with a longer vector component (length B) in the direction from discharge outlet 13 to impeller 3 than first triangle wall 15. In other words, second triangle wall 16 is made to have an area larger than first triangle wall 15.

Next, a description is made of effects and advantages due to the above-described configuration.

In typical centrifugal air blower 1, the airflow velocity inside casing 2 is supposedly slower near the side panels (i.e., inlet side panel 5 and motor-fixing side panel 8). The difference in airflow velocity unstabilizes the airflow direction near discharge outlet 13 and generates a turbulent flow.

In this embodiment, first triangle wall 15 and second triangle wall 16 allow cross-sectional area 18 of casing 2 in the area where air flows to be smaller toward the side panels (i.e., inlet side panel 5 and motor-fixing side panel 8), thereby increasing the volume of air passing through the unit area near the side panels. That is, first triangle wall 15 and second triangle wall 16 allow the airflow velocity to increase at the side panels (i.e., inlet side panel 5 and motor-fixing side panel 8) where the airflow velocity is slower.

There is some difference in between the airflow velocity near inlet side panel 5 and that near motor-fixing side panel 8. Hence, by further extending a triangle wall (first triangle wall 15 or second triangle wall 16) at a side panel (inlet side panel 5 or motor-fixing side panel 8) where the airflow velocity is slower than the other, cross-sectional area 18 of casing 2 where the airflow velocity is slower can be made smaller to increase the airflow velocity. This reduces the difference in the airflow velocity near discharge outlet 13, makes the air velocity uniform, and decreases airflow turbulence.

Owing to first triangle wall 15 and second triangle wall 16, the shape of discharge outlet 13 can be polygonal to approximately run along the curve of round adaptor 19. Hence, round adaptor 19 with a round cross section can be continuously connected with rectangular discharge outlet 13, which decreases airflow turbulence due to the rapid expansion and collision of discharge airflow 14.

Note that the triangle wall (first triangle wall 15 and second triangle wall 16) may be formed by creating a bent line oblique with respect to rotation shaft 11 of impeller 3 to bend the part near discharge outlet 13 at opposite-to-tongue 30 of scroll 6 toward impeller 3. In the present invention, a triangle wall formed by bending scroll 6 is not treated as part of scroll 6. Accordingly, even if scroll 6 is bent to form a triangle wall, the triangle shape of the triangle wall is enclosed by scroll 6, the open face of discharge outlet 13, and inlet side panel 5 or motor-fixing side panel 8, all which form the three sides.

In this way, a centrifugal air blower according to the first exemplary embodiment of the present invention further decreases airflow turbulence near the discharge outlet to suppress a decrease of static pressure, an increase of power consumption, and turbulent flow noise, caused by airflow turbulence.

Second Exemplary Embodiment

A description is made of a centrifugal air blower according to the second exemplary embodiment of the present invention. A component same as that of the first embodiment is given the same reference mark and its detailed description is omitted.

Figure 2:
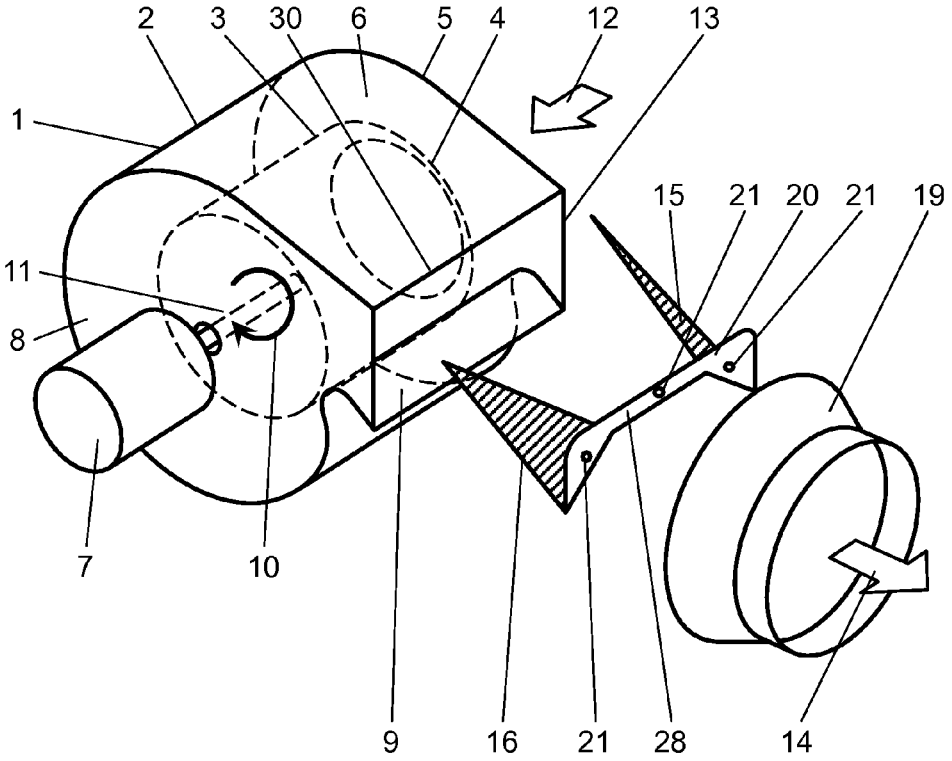
FIG. 2 is a perspective view of a centrifugal air blower according to the second exemplary embodiment of the present invention.

Centrifugal air blower 1 shown in FIG. 2 is provided with discharge outlet rectifier part 20, which is a component separate from scroll 6, at discharge outlet 13. Discharge outlet rectifier part 20 has first triangle wall 15 and second triangle wall 16.

Discharge outlet rectifier part 20 is connected to discharge outlet 13. First triangle wall 15 and second triangle wall 16 are shaped so that discharge outlet rectifier part 20 is obliquely bent from the open face of discharge outlet 13 toward impeller 3.

Discharge outlet rectifier part 20 has mounting flat panel 28 and mounting hole 21 for fixing round adaptor 19. Round adaptor 19 is connected to discharge outlet rectifier part 20 using mounting flat panel 28 and mounting hole 21.

Next, a description is made of effects and advantages due to the above-described configuration.

To form first triangle wall 15 and second triangle wall 16 by obliquely bending part of scroll 6 requiring a curving process, a special mold is required for bending first triangle wall 15 and second triangle wall 16 after the curving process, which increases the cost for the mold and processing work-hours.

Discharge outlet rectifier part 20 provided as a component separate from scroll 6 can simplify the shape of scroll 6.

Forming first triangle wall 15 and second triangle wall 16 at discharge outlet rectifier part 20 makes processing of the triangle walls easier and makes forming of their shape and size freer.

Further, mounting flat panel 28 allows obtaining a large surface that contacts round adaptor 19, which fixes round adaptor 19 easily and prevents airflow leakage through a gap between discharge outlet 13 and round adaptor 19. Mounting flat panel 28 increases adherence between discharge outlet 13 and discharge outlet rectifier part 20, which advantageously prevents an airflow that has passed from the inside of casing 2 through the gap between the ends of first triangle wall 15 and second triangle wall 16 and has flown into the triangle walls and scroll 6 from leaking from discharge outlet 13 to the outside.

Note that FIG. 2 shows a case where first triangle wall 15 and second triangle wall 16 are formed as a single-piece component, but they may be separate components formed individually.

In this way, the second exemplary embodiment of the present invention provides a centrifugal air blower that suppresses a decrease of static pressure and generation of noise due to air leakage near the discharge outlet while increasing the productivity of the scroll.

Third Exemplary Embodiment

Figure 3:
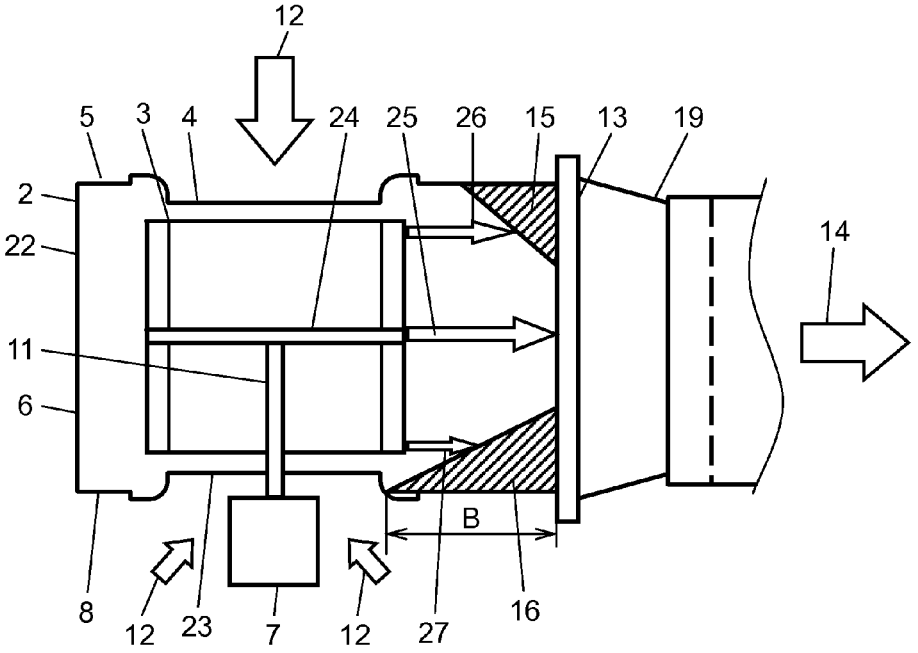
FIG. 3 is a top view illustrating the inside of a dual-inlet centrifugal air blower according to the third exemplary embodiment of the present invention.

A description is made of a centrifugal air blower according to the third exemplary embodiment of the present invention using FIG. 3. A component same as that of the first embodiment is given the same reference mark and its detailed description is omitted.

FIG. 3 is a top view illustrating the inside of dual-inlet centrifugal air blower 22 instead of centrifugal air blower 1. In dual-inlet centrifugal air blower 22, motor-side inlet 23 is formed at motor-fixing side panel 8 as well, and thus inlet airflow 12 flows into casing 2 through the two positions: inlet 4 and motor-side inlet 23. Then, second triangle wall 16 is made to be shaped with a longer vector component (length B) in the direction from discharge outlet 13 to impeller 3 than first triangle wall 15. In other words, second triangle wall 16 is made to have an area larger than first triangle wall 15.

Next, a description is made of effects and advantages due to the above-described configuration.

In dual-inlet centrifugal air blower 22, motor 7 is disposed at motor-side inlet 23 close to motor-fixing side panel 8, and because of this, the amount of air which flows into motor-side inlet 23 of motor-fixing side panel 8 is smaller than that which flows into inlet 4 of inlet side panel 5. Accordingly, the airflow velocity at discharge outlet 13 has large differences depending on the position: the fastest is impeller main panel airflow 25 at impeller main panel 24; next fastest is inlet side panel airflow 26 at inlet side panel 5; and the slowest is motor-fixing side panel airflow 27 at motor-fixing side panel 8. That is, the airflow velocity at second triangle wall 16 is the slowest.

Hence, further extending second triangle wall 16 to the inside of casing 2 (lengthening length B) increases the velocity of motor-fixing side panel airflow 27 at motor-fixing side panel 8, further reduces the difference in the airflow velocity at discharge outlet 13, and decreases airflow turbulence.

In this way, the third exemplary embodiment of the present invention provides a dual-inlet centrifugal air blower that further decreases airflow turbulence near the discharge outlet to suppress a decrease of static pressure, an increase of power consumption, and turbulent flow noise, caused by airflow turbulence.

Fourth Exemplary Embodiment

Figure 4:
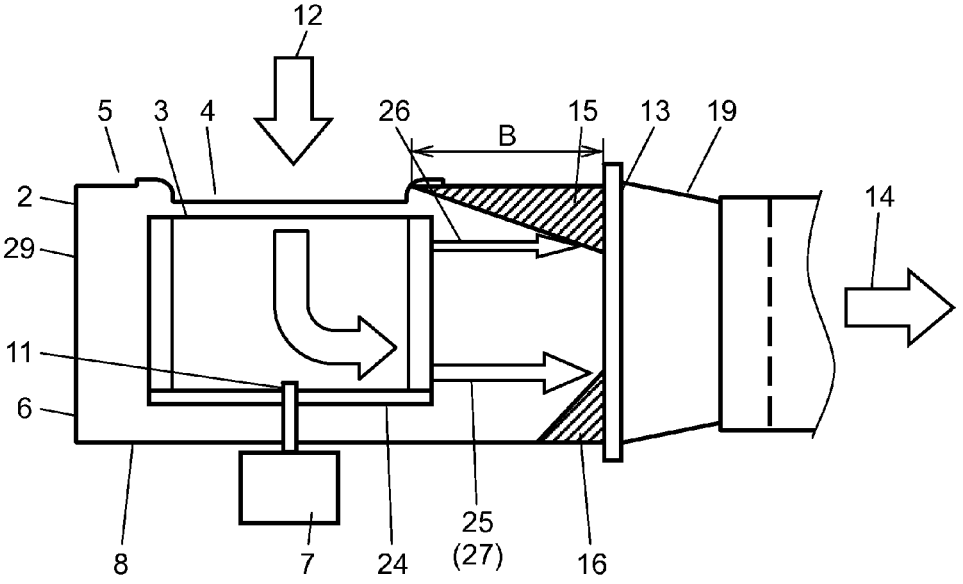
FIG. 4 is a top view illustrating the inside of a single-inlet centrifugal air blower according to the fourth exemplary embodiment of the present invention.
Figure 5:
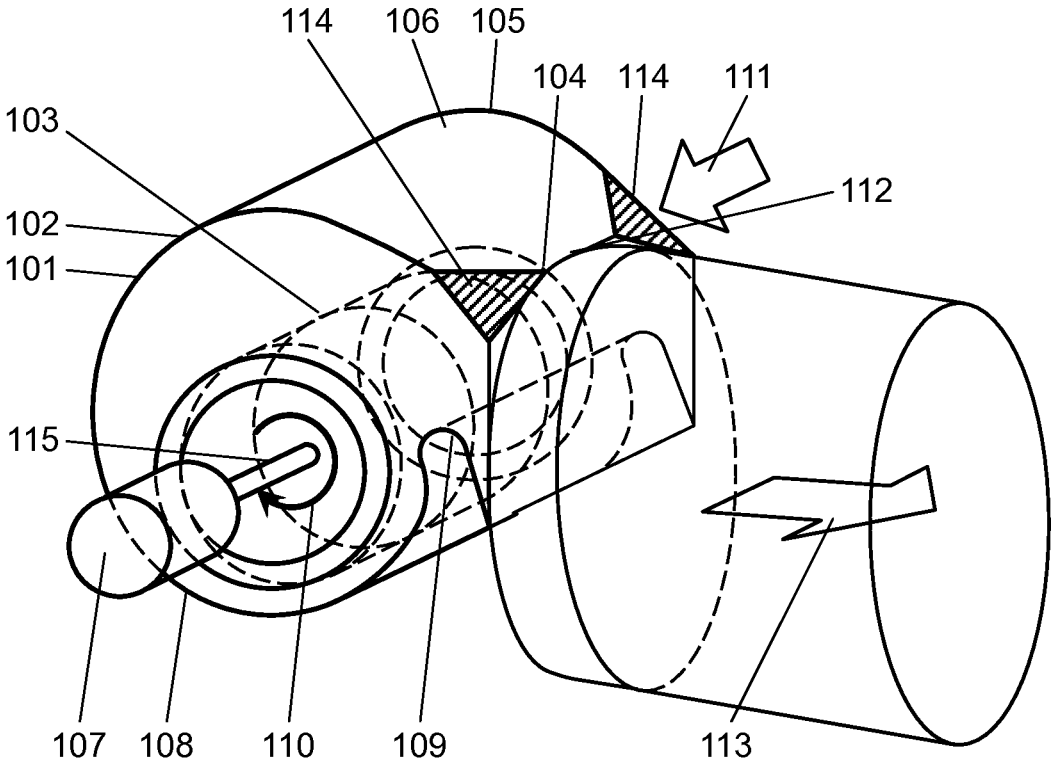
FIG. 5 is a perspective view of an existing centrifugal air blower.

A description is made of a centrifugal air blower according to the fourth exemplary embodiment of the present invention, using FIG. 4. A component same as that of the first embodiment is given the same reference mark its detailed description is omitted.

FIG. 4 is a top view illustrating the inside of single-inlet centrifugal air blower 29 instead of centrifugal air blower 1. First triangle wall 15 is made to be shaped with a longer vector component (length B) in the direction from discharge outlet 13 to impeller 3 than second triangle wall 16. In other words, first triangle wall 15 is made to have an area larger than second triangle wall 16.

Next, a description is made of effects and advantages due to the above-described configuration.

In typical single-inlet centrifugal air blower 29, gas that has flown from inlet 4 flows more at impeller main panel 24 side than the other side, and thus impeller 3 blows out more gas from impeller main panel 24 side than from the other side.

In single-inlet centrifugal air blower 29, impeller main panel 24 and motor-fixing side panel 8 are close to each other, and thus impeller main panel airflow 25 at impeller main panel 24 has approximately the same velocity as motor-fixing side panel airflow 27 at motor-fixing side panel 8.

Regarding airflow velocity at discharge outlet 13, impeller main panel airflow 25 at impeller main panel 24 is fast and inlet side panel airflow 26 at inlet side panel 5 is slow. That is, the airflow velocity at first triangle wall 15 is the slowest.

Hence, further extending first triangle wall 15 to the inside of casing 2 (lengthening length B) increases the velocity of inlet side panel airflow 26 at inlet side panel 5, further reduces the difference in the airflow velocity at discharge outlet 13, and decreases airflow turbulence.

In this way, a single-inlet centrifugal air blower according to the fourth exemplary embodiment of the present invention further decreases airflow turbulence near the discharge outlet to suppress a decrease of static pressure, an increase of power consumption, and turbulent flow noise, caused by airflow turbulence.

As described hereinbefore, a centrifugal air blower of the present invention includes a casing and an impeller contained in the casing. The casing includes a discharge outlet, a tongue, a spiral scroll, an inlet side panel having an inlet, and a motor-fixing side panel fixing the motor. The centrifugal air blower further includes a first triangle wall and a second triangle wall. The first surface is enclosed by the scroll, the inlet side panel, and the open face of the discharge outlet, at the part opposite to the tongue near the discharge outlet. The second surface is enclosed by the scroll, the motor-fixing side panel, and the open face of the discharge outlet, at the part opposite to the tongue near the discharge outlet. The first surface is inclined downward to the tongue toward the inlet side panel. The second surface is inclined downward to the tongue toward the motor-fixing side panel. In the case the air velocity inside the casing is slower at the inlet side panel than at the motor-fixing side panel when the motor is driven, the first triangle wall is shaped with a longer vector component in the direction from the discharge outlet to the impeller than the second. In the case the air velocity inside the casing is slower at the motor-fixing side panel than at the inlet side panel when the motor is driven, the second triangle wall is shaped with a longer vector component in the direction from the discharge outlet to the impeller than the first. Owing to this configuration, the cross-sectional area where the air flows in the casing cut along a plane vertical to the rotation shaft of the motor gradually becomes smaller toward the side panels (i.e., the inlet side panel and the motor-fixing side panel). In a typical centrifugal air blower, the airflow velocity inside the casing is supposedly slower near the side panels. By making the cross-sectional area of the casing at the side panels where the airflow velocity is slower smaller, the volume of air passing through the unit area is increased. That is, the velocity of airflow where the airflow velocity is slower can be increased. This configuration makes the air velocity near the discharge outlet uniform and decreases airflow turbulence.

There is some difference in between the airflow velocity near the inlet side panel and that near the motor-fixing side panel. Hence, by further extending the triangle wall where the airflow velocity is slower to the inside of the casing, the cross-sectional area of the casing can be made smaller to further increase the airflow velocity. This configuration reduces the difference in the airflow velocity near the discharge outlet and decreases airflow turbulence.

By making the shape of the discharge outlet polygonal owing to the first triangle wall and the second triangle wall, the round adaptor with a round cross section may be continuously connected with the discharge outlet.

This configuration decreases airflow turbulence due to the rapid expansion and collision of discharge airflow.

The first triangle wall and the second triangle wall may constitute a separate component from the scroll that is placed at the part opposite to the tongue near the discharge outlet.

This configuration allows the shape of the scroll to be simplified and the triangle wall to be formed freely in three dimensions. Further, a large surface that contacts the round adaptor is obtained, which fixes the round adaptor easily and prevents airflow leakage through a gap between the discharge outlet and the round adaptor.

For a dual-inlet centrifugal air blower, the second triangle wall may be shaped with a longer vector component in the direction from the discharge outlet to the impeller than the first.

In a dual-inlet centrifugal air blower 22, the motor is disposed at the inlet, and because of this, the amount of air which flows at the motor-fixing side panel is smaller and slower than that which flows at the inlet side panel. That is, the air flows slower at the second triangle wall. Further extending the second triangle wall to the inside of the casing reduces the difference in the airflow velocity at the discharge outlet to decrease airflow turbulence.

In a single-inlet centrifugal air blower, the first triangle wall may be shaped with a vector component in the direction from the discharge outlet to the impeller longer than the second.

In a single-inlet centrifugal air blower, gas that has flown from the inlet reaches the main panel of the impeller, changes its direction, and flows out. Hence, air flows faster at the main panel of the impeller (i.e., near the motor-fixing side panel) and more slowly near the inlet side panel. In other words, air flows more slowly at the first triangle wall. Further extending the first triangle wall to the inside of the casing further reduces the difference in the airflow velocity at the discharge outlet to decrease airflow turbulence.

The separate component of the air blower may be a discharge outlet rectifier part including the first triangle wall, the second triangle wall, and the mounting flat panel with a round adaptor fixed to it.

This configuration further decreases airflow turbulence due to the rapid expansion and collision of discharge airflow.

What is claimed is:

1. A centrifugal air blower comprising:

a casing including a discharge outlet, a tongue, a spiral scroll, an inlet side panel having an inlet, and a motor-fixing side panel fixing a motor;

an impeller contained in the casing;

a first triangle wall enclosed by the scroll, the inlet side panel, and an open face of the discharge outlet, at a part opposite to the tongue near the discharge outlet, the first triangle wall being inclined downward to the tongue toward the inlet side panel; and a second triangle wall enclosed by the scroll, the motor-fixing side panel, and the open face of the discharge outlet, at the part opposite to the tongue near the discharge outlet, the second triangle wall being inclined downward to the tongue toward the motor-fixing side panel, wherein the first triangle wall is shaped with a longer vector component in a direction from the discharge outlet to the impeller than the second triangle wall in a case that air velocity inside the casing is slower at the inlet side panel than at the motor-fixing side panel when the motor is driven, and wherein the second triangle wall is shaped with a longer vector component in the direction from the discharge outlet to the impeller than the first triangle wall in a case that air velocity inside the casing is slower at the motor-fixing side panel than at the inlet side panel when the motor is driven.

2. The centrifugal air blower of claim 1, wherein the first triangle wall and the second triangle wall constitute a separate component from the scroll, and is disposed at the part opposite to the tongue near the discharge outlet.

3. The centrifugal air blower of claim 1, wherein the centrifugal air blower is a dual-inlet centrifugal air blower, and wherein the second triangle wall is shaped with a longer vector component in the direction from the discharge outlet to the impeller than the first triangle wall.

4. The centrifugal air blower of claim 1, wherein the centrifugal air blower is a single-inlet centrifugal air blower, and wherein the first triangle wall is shaped with a longer vector component in the direction from the discharge outlet to the impeller than the second triangle wall.

5. The centrifugal air blower of claim 2, wherein the separate component is a discharge outlet rectifier part comprising the first triangle wall, the second triangle wall, and a mounting flat panel, and wherein a round adaptor is fixed to the mounting flat panel.

* * * * *